US010094557B2

(12) United States Patent
Manning et al.

(10) Patent No.: US 10,094,557 B2
(45) Date of Patent: Oct. 9, 2018

(54) BURNER

(71) Applicant: KILN FLAME SYSTEMS LIMITED, High Wycombe, Buckinghamshire (GB)

(72) Inventors: Richard Manning, Rickmansworth (GB); Clifford Rennie, Wallingford (GB); Christopher Sansom, Croxley Green (GB); Clayton Holmes, Malvern (GB)

(73) Assignee: Kiln Flame Systems Limited, High Wycombe, Buckinghamshire (GB)

( * ) Notice: Subject to any disclaimer, the term of this patent is extended or adjusted under 35 U.S.C. 154(b) by 371 days.

(21) Appl. No.: 14/892,258

(22) PCT Filed: Mar. 21, 2014

(86) PCT No.: PCT/EP2014/055743

§ 371 (c)(1),
(2) Date: Nov. 19, 2015

(87) PCT Pub. No.: WO2014/187591

PCT Pub. Date: Nov. 27, 2014

(65) Prior Publication Data

US 2016/0084497 A1 Mar. 24, 2016

(30) Foreign Application Priority Data

May 20, 2013 (GB) ..... 1309008.9

(51) Int. Cl.
*F23D 14/58* (2006.01)
*F23D 14/48* (2006.01)

(52) U.S. Cl.
CPC ..... *F23D 14/58* (2013.01); *F23D 14/48* (2013.01); *F23D 2900/14003* (2013.01)

(58) Field of Classification Search
CPC ..... F23D 14/48; F23D 14/58; F23D 2900/14003; F23D 14/20; F23D 14/22; F23D 17/00; F23D 14/00
See application file for complete search history.

(56) References Cited

U.S. PATENT DOCUMENTS

2008/0213714 A1 9/2008 Knoch

FOREIGN PATENT DOCUMENTS

| | | |
|---|---|---|
| DE | 2127474 A1 | 12/1972 |
| EP | 0650012 A1 | 4/1995 |
| GB | 2310037 A | 8/1997 |

*Primary Examiner* — Alfred Basichas
(74) *Attorney, Agent, or Firm* — Gable Gotwals

(57) ABSTRACT

This invention relates to a burner 100 including a burner body 110 having a burner chamber with a backing plate 122 and having a burner element received in the burner chamber, the burner element having a plurality of gas nozzles 117 for supplying gas into the burner mounted therein for rotational movement such that the direction of gas exiting the gas nozzle can be adjusted. The burner is characterized by means for rotating the gas nozzles 117 which are provided on the backing plate 121 and by releasable means for retaining each gas nozzle 117 in a plurality of rotational configurations provided outside the burner chamber. The burner allows for tuning of gas flow from outside the burner while it is in use.

12 Claims, 6 Drawing Sheets

BURNER

CROSS-REFERENCE TO RELATED APPLICATIONS

Figure 1:
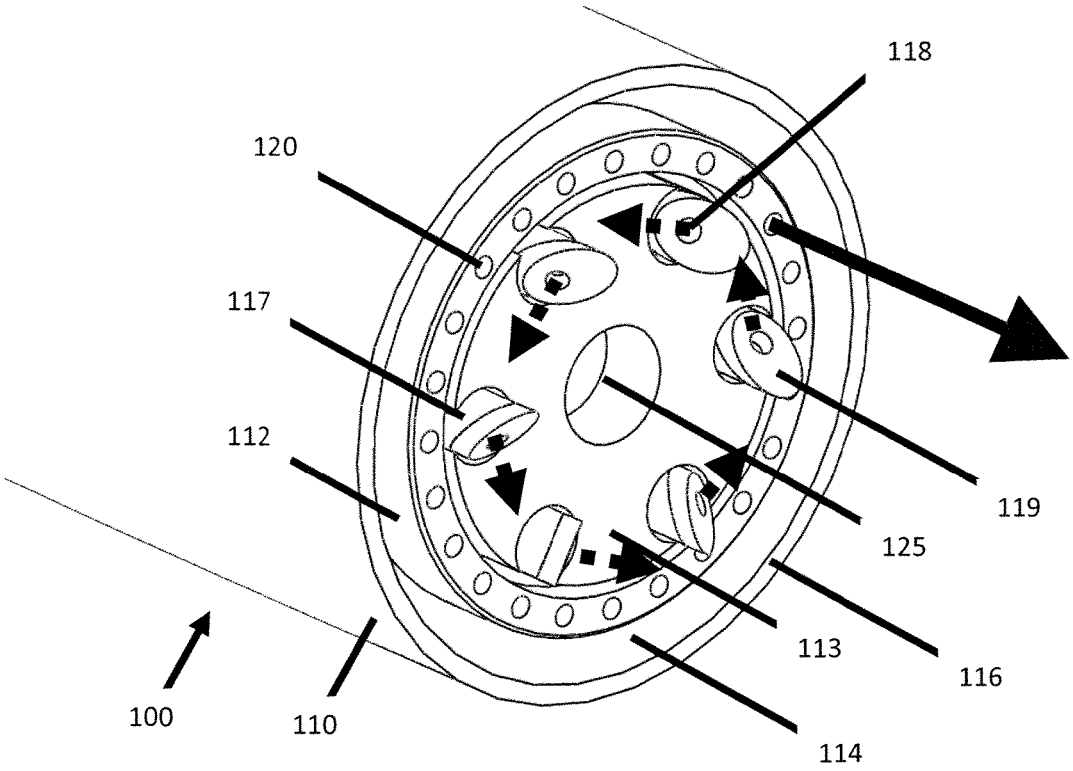

This application is the United States National Phase of Patent Application No. PCT/EP2014/055743 filed 21 Mar. 2014, which claims priority to British Patent Application No. 1309008.9 filed 20 May 2013, each of which is incorporated herein by reference.

This invention relates to burners. More especially but not exclusively the invention relates to burners for use in making cement, for lime-burning, for metal reduction or use in lime recovery kilns in paper-making. The invention is not so limited.

GB2310037 describes a range of burners where individual gas nozzles are adjustable. The nozzles in each case are spheres with an axial bore. The nozzles are retained in a tip. In some embodiments the sphere is held in the desired configuration by a grub screw passing through the nozzle and engaging the sphere. In some embodiments the tip terminates in a male screw threaded portion on which is screwed a nut having an inwardly directed flange. Trapped between the end of the pipe and the flange of the nut is a seating cylinder and a nozzle holder. The seating cylinder is provided with a flange which abuts the end of tip. The other end of seating cylinder has a seat for the spherical nozzle. The nozzle holder has an inwardly directed flange such that the nozzle can be trapped between the inwardly directed seat of the nozzle holder. The nozzle holder has, also, an outwardly directed flange by means of which it is trapped between the nut and the tip. By tightening the nut the nozzle can be held in a desired position. By loosening the nut the nozzle can be adjusted. In other embodiments the nozzles are retained by a plate with a plurality of holes in it each hole somewhat smaller than the diameter of the nozzles. The end of the burner is provided with a plurality of holes in which the nozzles are received. The nozzles are trapped between the plate and the end of the burner. A screw threaded fastener passes through the plate and into the body of burner thereby allowing the nozzles to be adjusted and then held in position. This arrangement suffers from several disadvantages. After being used for some time the various screw threaded portions will become difficult to move following exposure to heat, particulate matter and oxidizing conditions. Furthermore the adjustment means are accessible only from within the burner. Accordingly it is only possible to adjust the burner when it is not in use. Additionally it can be difficult accurately to align nozzles. As a result optimisation can become difficult and time consuming.

The invention seeks to provide a burner where individual nozzles, especially gas fuel nozzles are adjustable even while the burner is in use.

According to the invention there is provided a burner comprising a burner body having a burner chamber with a backing plate and having a burner element received in the burner chamber, the burner element having a plurality of gas nozzles for supplying gas into the burner mounted therein for rotational movement such that the direction of gas exiting the gas nozzle can be adjusted wherein means for rotating the gas nozzles are provided on the backing plate and wherein releasable means for retaining each gas nozzle in a plurality of rotational configurations is provided outside the burner chamber. The retaining means can be provided on the backing plate. Each gas nozzle can comprise a cylindric section having an elliptical face and a gas passage formed in the face. One or more, and preferably each gas nozzle is provided with a tell-tale visible from outside the burner indicating the rotational position of the nozzle in the burner. The burner can further comprise means for supplying solid fuel to the burner. The burner can further comprise non-rotatable means for supplying gas into the burner. According to the invention there is further provided a method of burning a gaseous fuel comprising the steps of passing a mixture of inflammable gas and an oxidising agent through a burner of the invention and combusting the mixture.

Figure 2:
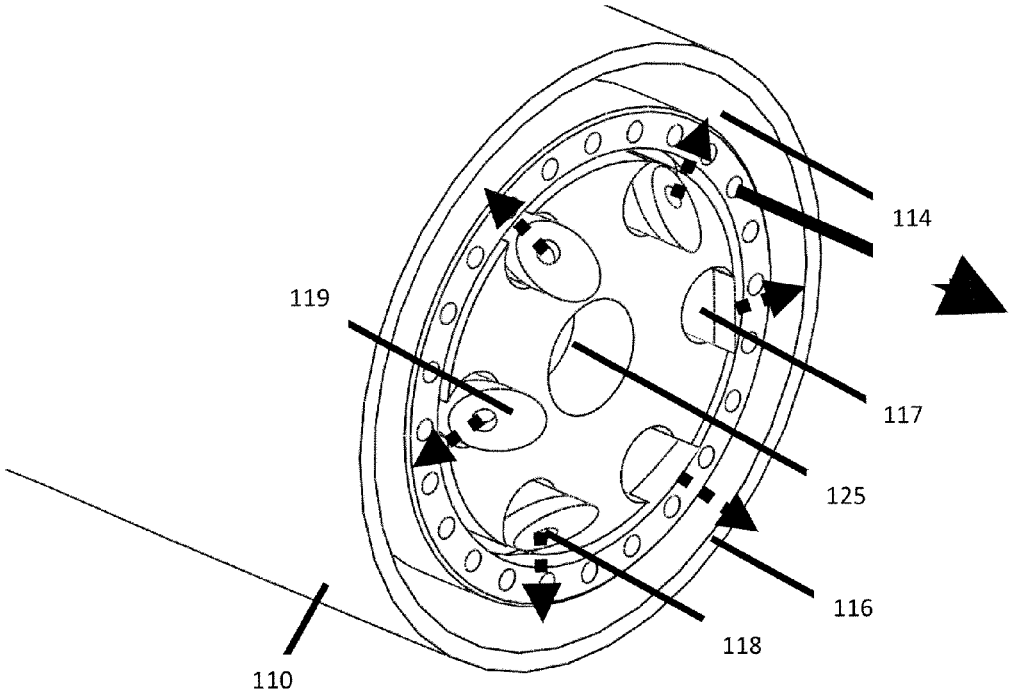
Figure 3:
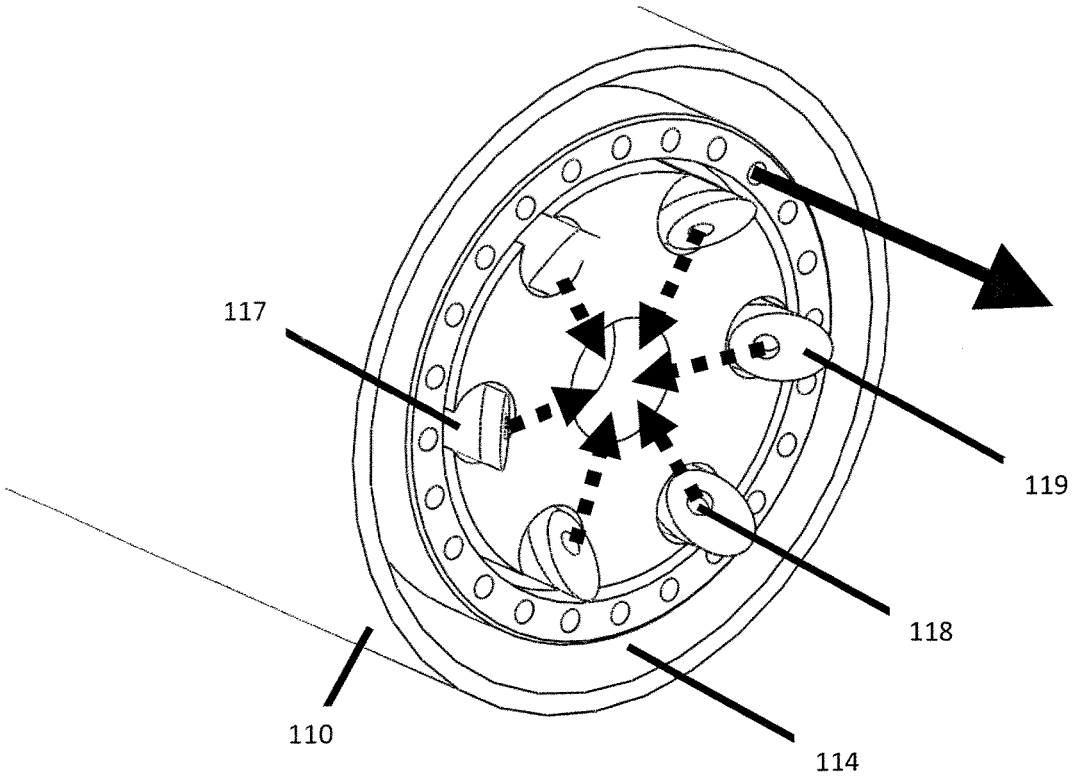
Figure 4:
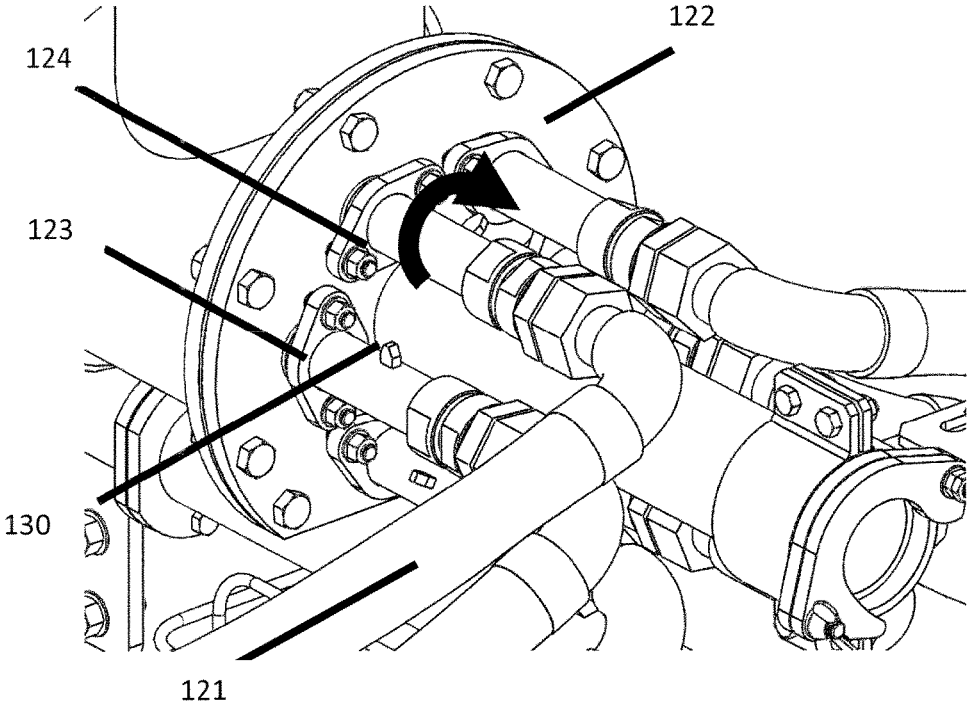

Embodiments of the invention will be described by way of non-limiting example by reference to the accompanying figures of which FIG. 1 is a partial perspective view of a burner of the invention in a first configuration FIG. 2 is a partial perspective view of the burner of FIG. 1 in a second configuration FIG. 3 is a partial perspective view of the burner of FIG. 1 in a third configuration FIG. 4 is a partial rear perspective view of the burner of FIG. 1

Figure 5:
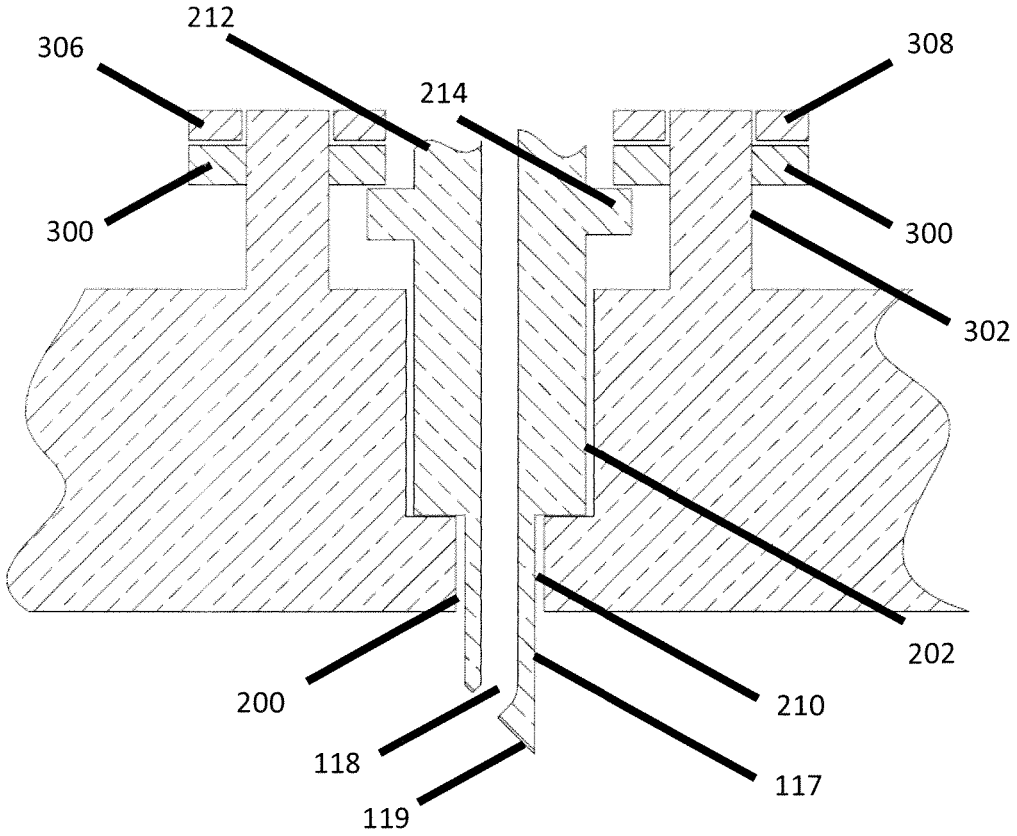
Figure 6:
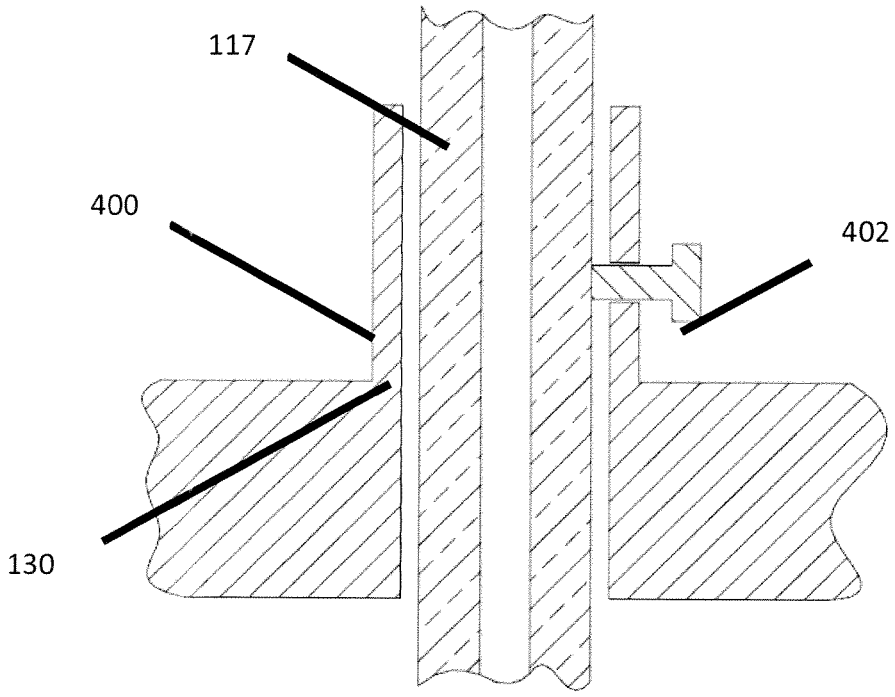

FIG. 5 is a partial cross section of a burner backing plate and swirl nozzle and FIG. 6 is a partial cross section of a further burner backing plate and swirl nozzle.

Burner 100 comprises a cylindrical body 110 which forms a chamber. A burner element is received inside the body 110. The burner element may be provided with a right circular cylindrical portion 112 having a circular face 113. A gap 114 is thus defined between the inside of the body and the outside of the element. Preferably this gap is annular but other arrangements such as angular segments can be used. Means for injecting a fuel such as a solid fuel such a powdered pet coke and air into the gap could be provided but this is not essential. The face of the burner element can be provided with a plurality of gas passages 120 which are perpendicular to the circular face 113. These passages may be disposed about the perimeter of an imaginary circle. The above mentioned features allow fuel and air to be expelled from the burner in axial manner.

In accordance with the invention means for providing gas such as fuel gas where the angle of flow of material exiting the burner is adjustable are provided. Hereinafter the expression "adjustable gas" is used in connection with this. In the illustrated embodiment adjustable gas is provided by a plurality of gas pokers 117. In the illustrated embodiment the gas pokers are each in the form of a cylindric section with a gas passage 118 provided in the elliptical face 119 and perpendicular to that face. Those skilled in the art will be able to devise other methods of introducing adjustable gas air such as bent pipes. The precise angle at which the adjustable gas diverges from the angle of axial flow is not of the essence of the invention. Good results can be achieved where the angle is in the range of 20 to 70 degrees for example 30 to 60 degrees more preferably 40 to 50 degrees. In the illustrated embodiment the gas pokers are equidistantly disposed about an imaginary circle with its centre at the centre of the burner. This is preferred but the gas pokers need not be equidistantly disposed or disposed about an imaginary circle. In the event they are disposed about an imaginary circle that circle need not have its centre at the centre of the burner. The precise number of gas pokers is not of the essence of the invention. In the illustrated embodiment 6 are provided but fewer such as 4 or more such as 8 could be used The gas pokers are rotatable. Preferably the gas pokers are independently rotatable. Rotation of the gas pokers nozzles enables the non-axial gas flow to be adjusted allowing tuning of the burner. This can be seen by comparing FIGS. 1 to 3 where in FIG. 1 the swirl nozzles are pointed to the side, in FIG. 2 they are pointed to the outside of the burner and in FIG. 3 where they are pointed towards the centre of the burner. It will be apparent to the skilled worker that these variations will have a substantial effect on the disposition of gas in the burner and thus that they allow the burner to be tuned. The skilled worker will of course appreciate that it is not necessary for each gas poker to be rotated to the same degree as every other gas poker and in many cases there will be differences Means for rotating the gas pokers from outside the burner chamber are provided. Means for retaining the gas pokers in configuration which are accessible from outside the burner chamber are also provided. Those skilled will have no difficulty in devising suitable means. The means for rotating can simply comprise a portion of the feed pipe to the swirl nozzle outside the burner chamber.

FIG. 4 shows an embodiment. The rear of the burner is defined by backing plate 122. Feed pipes 121 feed gas to the gas poker 117 at the backing plate which is to say outside the burner chamber and not exposed to fuel and oxidant or the products of combustion. Typically at least a portion of the feed pipe is flexible or at any rate deformable. Those skilled in the art will have no difficulty suitable materials for the feed pipe. Feed pipe 121 is mounted to gas poker to allow gas to be passed through the gas poker for example by conventional unions and swivel joints. Rotation of the gas poker from outside the burner can thus be achieved by rotating a portion of the gas poker outside the burner or by moving the feed pipe or some component to either of these members. Desirably but not essentially a tell-tale 130 such as an upstand or indicia can be provided on the gas pokers to provide information about the orientation of the gas passage of the poker.

In some cases suppliers' representatives will tune the burner by manipulating the gas pokers and once the desired configuration is achieved the swivel joints removed or adjustment means locked to prevent tampering by end-users.

Means for releasably retaining the gas pokers in position are provided. Those skilled in the art will have no difficulty in devising suitable methods of achieving this. In the embodiment of FIG. 4 flange 300 bears against an enlarged portion of the gas poker and screw threaded fasteners 306, 308 when tightened retain the gas poker in position. When slackened the poker can be rotated.

Another method shown in FIG. 5. Backing plate 122 is provided with a through bore 200 extending into the burner chamber. The bore is provided with a counterbore, or enlarged section, 202 at the end remote from the burner chamber. Gas poker 117 comprises a small diameter nose portion 210 which can pass through the bore and counterbore. Gas poker 117 is provided also with a larger diameter seat portion 212 which can pass through the bore but not through the counterbore. By appropriate dimensioning of the burner and gas poker the gas poker can be arranged so that the seat portion engages the counterbore with the gas passage correctly positioned in the burner.

Outboard of the seat portion, ie further away from the gas passage 118, the gas poker is provided with an outwardly extending lip 214. Flange 300 is provided with a hole 302. Hole 302 is of lesser diameter than the lip 214. Flange 300 is mounted on the gas poker outboard of the lip. Mounting holes 304 are provided in the flange such that screw threaded fasteners 306, 308 carried on the backing plate 122 can be tightened to urge the seat portion 212 against the counterbore 202 thereby restricting movement, both axial and rotational of the gas poker. Loosening of the screw threaded fasteners allows the gas poker to be rotated to a desired position. By disengaging the screw threaded fastener the gas poker can be withdrawn from the burner for example for servicing.

Other methods of releasably retaining the gas poker against rotation can be used. For example in FIG. 6 the backing plate 122 can be provided with an upstanding collar 400 surrounding the through bore. One of more screw threaded members 402 can pass through the collar and engage the gas poker 117. In other embodiments a collet arrangement could be used with for example a threaded split collar urged towards the swirl nozzle by a tapered nut.

While in the illustrated embodiments the retaining means are provided at the rear of the burner it is not essential that they are positioned there. They could for example pass through the side wall of the burner.

The invention allows the gas pokers to be individually adjusted and secured in position while the burner is in operation thereby allowing rapid and efficient burner tuning.

The invention claimed is:

1. A burner (100), said burner comprising:

a burner body (110) having a burner chamber with a backing plate (122) and having a burner element received in the burner chamber, the burner element having a plurality of gas nozzles (117) for supplying gas into the burner mounted therein for rotational movement such that the direction of gas exiting the each gas nozzle in the plurality of nozzles can be adjusted;

the plurality of gas nozzles are independently rotatable;

each nozzle in the plurality of gas nozzles is adjustable while the burner is in use, rotational means for rotating the plurality of gas nozzles (117) are provided on the backing plate (122); and releasable means for retaining each gas nozzle (117) in a plurality of rotational configurations is provided outside the burner chamber.

2. A burner as claimed in claim 1 wherein each gas nozzle is provided with a tell-tale (130) visible from outside the burner indicating a rotational position of a nozzle in the burner.

3. A burner as claimed in claim 1 further comprising means for supplying solid fuel to the burner.

4. A burner as claimed in claim 1 further comprising non-rotatable means (120) for supplying gas into the burner.

5. A burner as claimed in claim 1 wherein each gas nozzle (117) comprises a cylindrical section having an elliptical face (119) and a gas passage (118) being formed in the face (119).

6. A burner as claimed in claim 5 wherein each gas nozzle is provided with a tell-tale (130) visible from outside the burner indicating the rotational position of the nozzle in the burner.

7. A burner as claimed in claim 1 wherein the releasable means for retaining each nozzle are provided on the backing plate (121).

8. A burner as claimed in claim 7 wherein each gas nozzle comprises a cylindrical section having an elliptical face and gas passage being formed in the face.

9. A burner as claimed in claim 7 wherein each gas nozzle is provided with a tell-tale (130) visible from outside the burner indicating the rotational position of the nozzle in the burner.

10. A method of burning a gaseous fuel comprising the steps of:

passing a mixture of inflammable gas and an oxidizing agent through a burner and burning the mixture, wherein said burner comprises a burner body (110) having a burner chamber with a backing plate (122) and having a burner element received in the burner chamber, the burner element having a plurality of gas nozzles (117) for supplying gas into the burner mounted therein for rotational movement such that the direction of gas exiting the gas nozzle can be adjusted; and the gas nozzles are independently rotatable;

the individual nozzles are adjustable while the burner is in use, rotational means for rotating the gas nozzles (117) are provided on the backing plate (121) and releasable means for retaining each gas nozzle (117) in a plurality of rotational configurations is provided outside of the burner chamber.

11. A method as claimed in claim 10 wherein the releasable means for retaining each nozzle is provided on the backing plate.

12. A method as claimed in claim 10 wherein each gas nozzle is provided with a tell-tale visible from outside the burner indicating a rotational position of the nozzle in the burner.

* * * * *